US006889396B2

(12) United States Patent
Weinman

(10) Patent No.: US 6,889,396 B2
(45) Date of Patent: May 10, 2005

(54) ADJUSTABLE BED MATTRESS CLIP

(75) Inventor: Adam Michael Weinman, Tampa, FL (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/335,904

(22) Filed: Jan. 3, 2003

(65) Prior Publication Data

US 2004/0128762 A1 Jul. 8, 2004

(51) Int. Cl.[7] ..... A47C 21/00
(52) U.S. Cl. ..... 5/411; 5/613
(58) Field of Search ..... 5/411, 613, 412, 5/659, 658; 297/228.13, 219.1

(56) References Cited

U.S. PATENT DOCUMENTS 1,559,119 A * 10/1925 Miller ..... 5/411
2,588,854 A * 3/1952 Lang ..... 5/618
2,995,762 A * 8/1961 Albinson ..... 5/411
4,381,571 A 5/1983 Elliott
4,385,410 A 5/1983 Elliott et al.
4,407,030 A 10/1983 Elliott
4,726,083 A * 2/1988 Hoshall ..... 5/411
4,899,404 A * 2/1990 Galumbeck ..... 5/616
5,499,410 A * 3/1996 Assink ..... 5/411
5,537,701 A 7/1996 Elliott
5,832,550 A * 11/1998 Hauger et al. ..... 5/621
5,870,784 A 2/1999 Elliott
6,276,011 B1 8/2001 Antinor

FOREIGN PATENT DOCUMENTS

WO WO 2004/028306 A1 4/2004

* cited by examiner

*Primary Examiner*—Michael Trettel
(74) *Attorney, Agent, or Firm*—Diller, Ramik & Wight

(57) ABSTRACT

A mattress clip is provided which, when used in pairs, secures a mattress to an adjustable bed to prevent the mattress from sliding off leg, thigh, hip and back supports of the adjustable bed. Two clips are secured to the thigh support in cantilever fashion with opposing free ends projecting toward each other and being received in axial open ends of a tube sewn to a cover of the mattress. Though limited transverse and longitudinal motion of the mattress relative to the leg, thigh, hip and back supports can take place during adjusting movements of the adjustable bed, the mattress is precluded from excessive shifting and cannot inadvertently or accidentally slide off the supports. Each mattress clip includes elongated openings through which bolts are passed for reception in aligned openings of the thigh support to permit limited transverse adjustment of the mattress clips.

44 Claims, 7 Drawing Sheets

FIG. 12
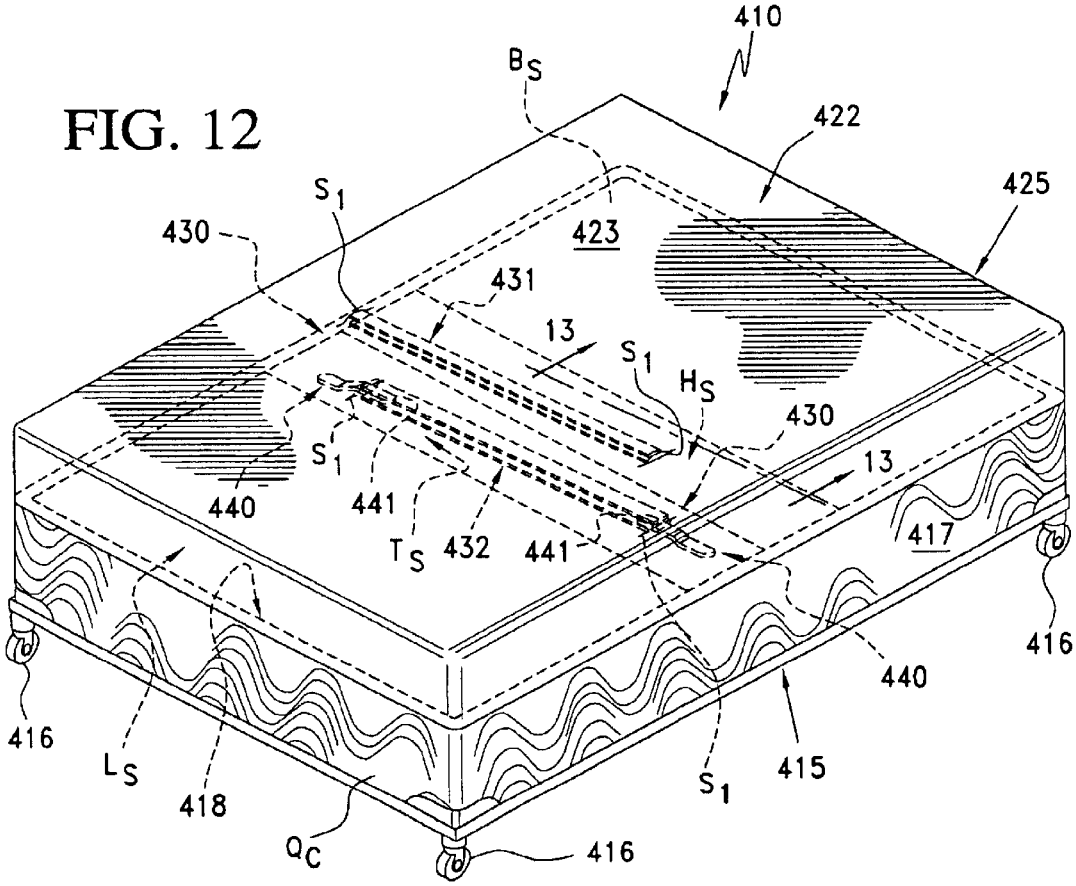
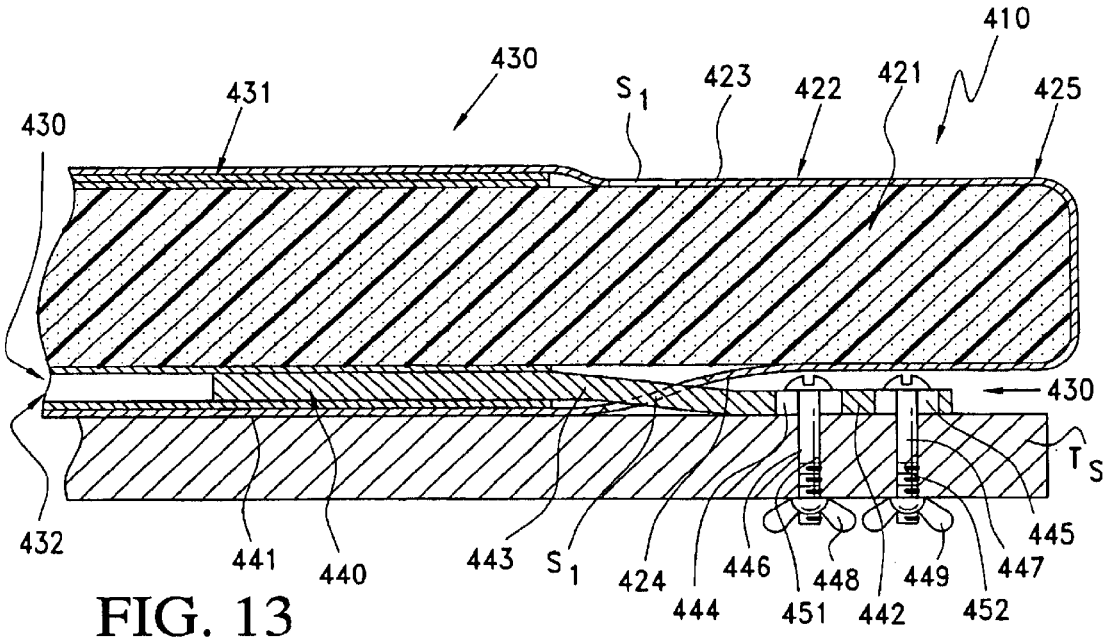
FIG. 13

FIG. 14
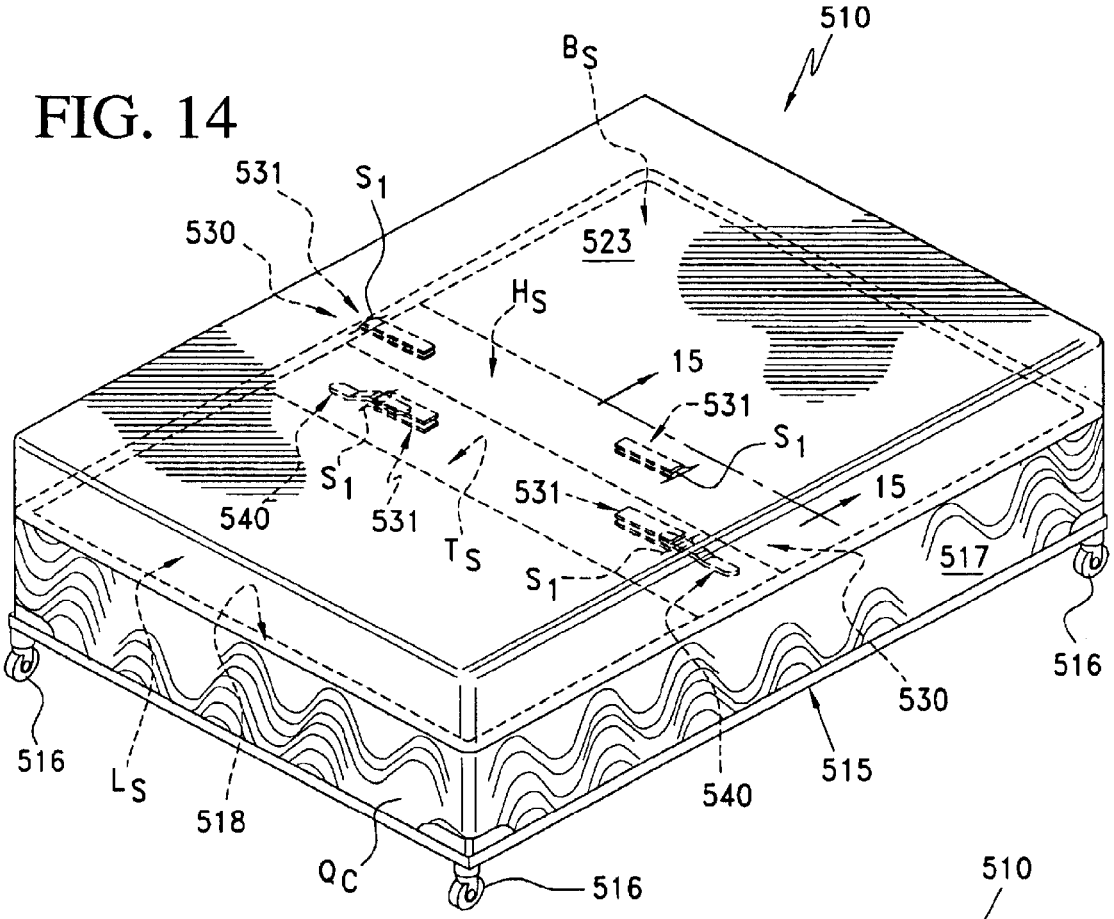
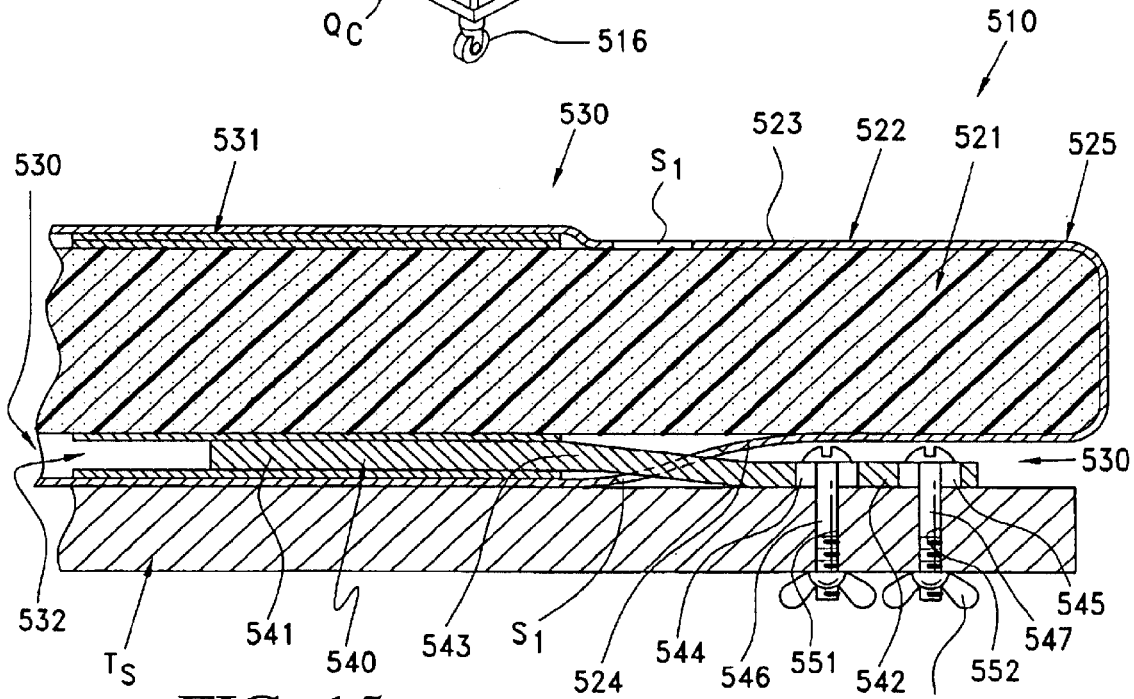
FIG. 15

ADJUSTABLE BED MATTRESS CLIP

BACKGROUND OF THE INVENTION

The invention is directed to an adjustable bed and specifically to a pair of identical mattress clips which are associated with a mattress to prevent the mattress from sliding off the adjustable bed, particularly when the adjustable bed is moved between its various positions of adjustment.

A conventional adjustable bed includes an adjustable frame which is utilized in conjunction with several supports upon which a mattress rests. The adjustable frame can be adjusted to move between a substantially horizontal planar position to one of several positions in which leg, thigh and back supports are inclined at an angle to the horizontal to provide appropriate adjustment while a person sleeps, eats, reads, watches television or is otherwise required to spend considerable lengths of time in bed for therapeutic purposes, as might occur should such a person be injured or is suffering from physical or mental problems. Typical of such adjustable or articulated beds are those disclosed in U.S. Pat. Nos. 4,381,571; 4,385,410; 4,407,030; 5,537,701; 5,870,784 and 6,276,011 B1. In such articulated beds a foot retainer is generally used to prevent the mattress from sliding off the mattress supports. Side mattress retainers have also been utilized to prevent mattresses from sliding laterally off mattress supports. Whether in the form of a foot or base retainer or a side retainer, such retainers are visible to the consumer and immediately "earmark" the bed as being adjustable. As such, adjustable beds have a bad connotation with a percentage of the bed purchasing public because purchasers believe adjustable beds appear "medical" and are designed for older or geriatric users. By virtue of the adjustable bed mattress clips of the present invention, an adjustable bed appears to be a conventional "normal" bed because the mattress clips are sandwiched between the mattress and the mattress supports and permits the adjustable bed to appear mainstream and in turn becomes more marketable to a larger customer base.

SUMMARY OF THE INVENTION

In keeping with the foregoing, a primary object of the invention is to provide an adjustable bed which is of a conventional construction insofar as it includes the typical supports and adjusting mechanisms of the latter-identified patents, but significantly differs therefrom by providing a novel mattress clip which is utilized in pairs to retain a bed mattress supported upon supports of the adjustable bed to prevent the mattress from sliding off the latter either longitudinally or transversely. The adjustable bed preferably includes an adjustable bed frame defined by a backrest frame, a hip frame, a thigh frame and a leg frame which respectively support a back support, a hip support, a thigh support and a leg support. A mattress is supported atop the latter supports and the mattress clips of the present invention are sandwiched between an underside of the mattress and one of the mattress supports, preferably the thigh support.

Each of the mattress clips is an elongated member having opposite ends with one end being adjustably secured to the thigh support and the opposite end being cantilevered and housed within an open end of a fabric tube sewn or otherwise secured to the underside of the mattress cover substantially normal to a longitudinal axis of the mattress. The latter arrangement of the mattress clips prevents the mattress from sliding off the mattress supports either transversely or longitudinally in any position of the adjustable bed whether stationary or during adjusting movement thereof.

In lieu of a single fabric tube or sleeve secured to the underside of the mattress covering, two separate tubes can be secured in transverse alignment to the underside of the mattress covering. As a further embodiment, in lieu of a sleeve or tube, a strip of material can be sewn directly to an exterior of the mattress cover normal to the longitudinal axis of the mattress with opposite ends of the strip of material being open which allows the clips to be slid into these open opposite ends. Thus, the single strip of material is sewn only along longitudinal edges thereof to the mattress cover which in effect defines a "tube" between the strip of material and the mattress cover having axial open ends which can receive the mattress clips. As an alternative to the latter, the transverse edges of the strip of material can also be sewn to the cover and inboard of transversely sewn ends there is provided a slot for each mattress clip for entry into the sleeve or tube, again formed by the separate transverse strip of material and the portion of the mattress cover to which it is sewn. However, no matter the construction of the strip or tube, the same need but provide access therethrough for the oppositely opposing cantilevered ends of the mattress clips to thereby retain the mattress in position and prevent slippage thereof.

A less desirable alternate to the latter constructions would be to provide the mattress covering with such transversely aligned slits and sew a separate piece of fabric transversely to an interior surface of the mattress covering. The cantilevered end of each mattress clip would then enter each slit of the mattress cover from the exterior and enter the sleeve or tube interiorly of the mattress covering. The latter construction obviously hides the transverse strip interiorly of the mattress which provides aesthetic benefits, particularly if the mattress covering is reinforced in the area of the slits.

No matter the construction for the tube, pocket, sleeve or the like, with or without mattress cover slits, such can be provided at both top and bottom cover portions of the mattress cover to permit the mattress to be "flipped," and in either position the mattress clips are operative to prevent the mattress from slipping off the mattress supports.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 12 is a perspective view of another adjustable bed, and illustrates a mattress having transversely aligned inner pockets in upper and lower portions of the mattress cover and ends of cantilevered mattress retention brackets being received in the pockets through slits or openings in the mattress cover.

FIG. 13 is a fragmentary enlarged cross sectional view taken generally along line 13—13 of FIG. 12, and illustrates the end portion of one of the cantilevered mattress retention clips being received in one of the inner mattress pockets through an associated slit or opening in the mattress cover.

FIG. 14 is a perspective view of another adjustable bed, and illustrates upper and lower interior transversely aligned pairs of pockets associated with the mattress and ends of cantilevered mattress retention clips being received in the lower pockets through slits in the mattress cover.

FIG. 15 is an enlarged fragmentary cross-sectional view taken generally along line 15—15 of FIG. 14, and illustrates details of the cantilevered mattress retention bracket or clip relative to its associated pocket and mattress cover slit.

DESCRIPTION OF THE PREFERRED EMBODIMENTS

Figure 1:
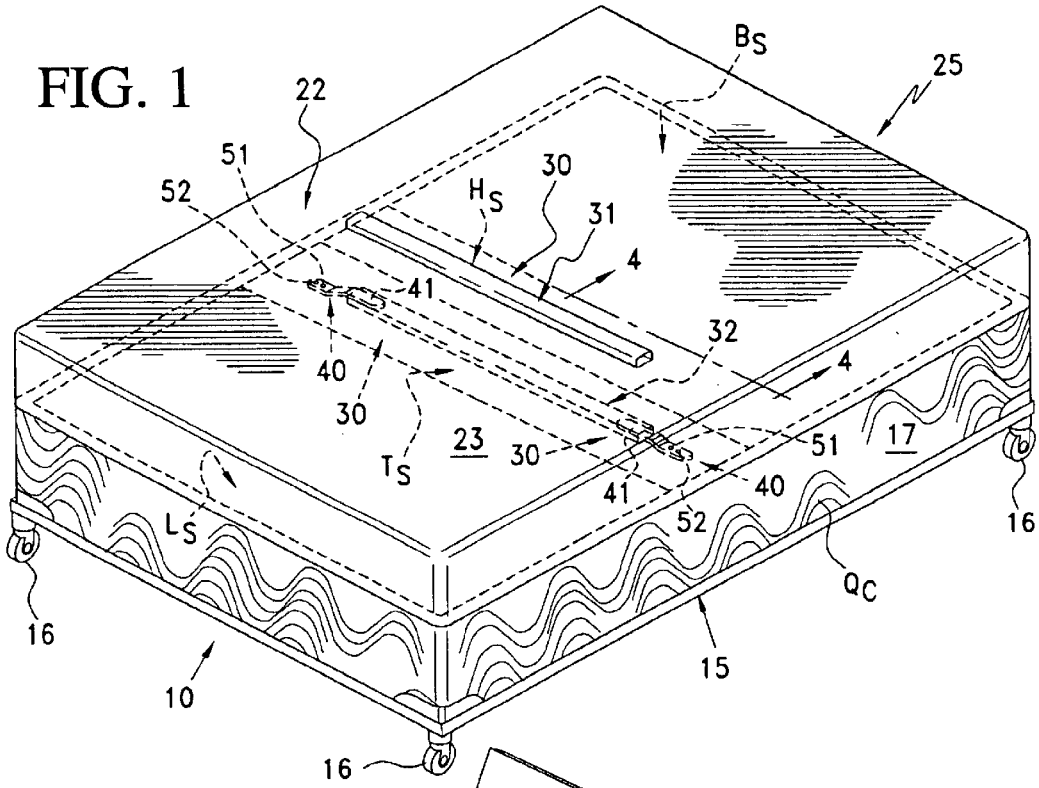
FIG. 1 is a top perspective view of a novel adjustable bed constructed in accordance with this invention, and illustrates an adjustable bed including a main frame, a plurality of relatively movable mattress supports, a mattress supported atop the mattress supports, and opposing cantilevered mattress retention clips carried by one of the mattress supports and received in axially opposite open ends of a lower tube, sleeve or pocket secured to an underside of a cover of the mattress.
Figure 2:
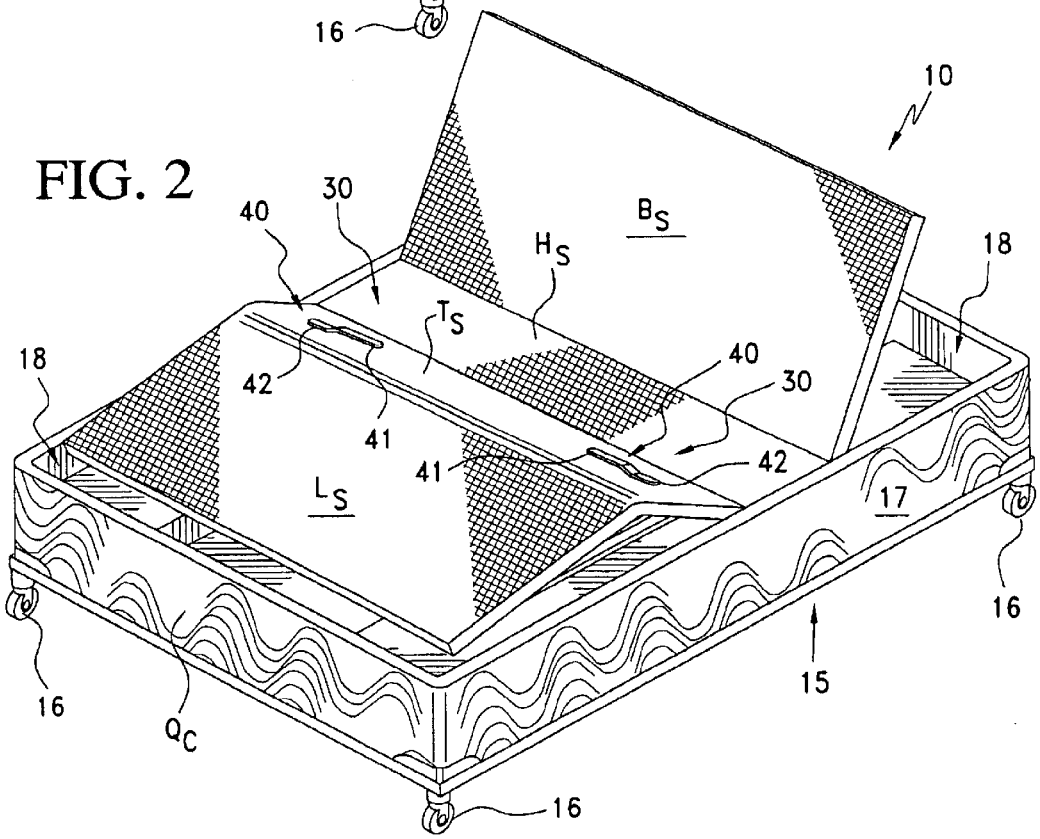
FIG. 2 is a perspective view of the adjustable bed of FIG. 1 with the mattress removed, and illustrates the mattress supports in one of a multiplicity of adjusted positions and two transversely aligned mattress retention clips.

An adjustable bed constructed in accordance with this invention is illustrated in FIGS. 1 and 2 of the drawings and is generally designated by the reference numeral 10.

Figure 3:
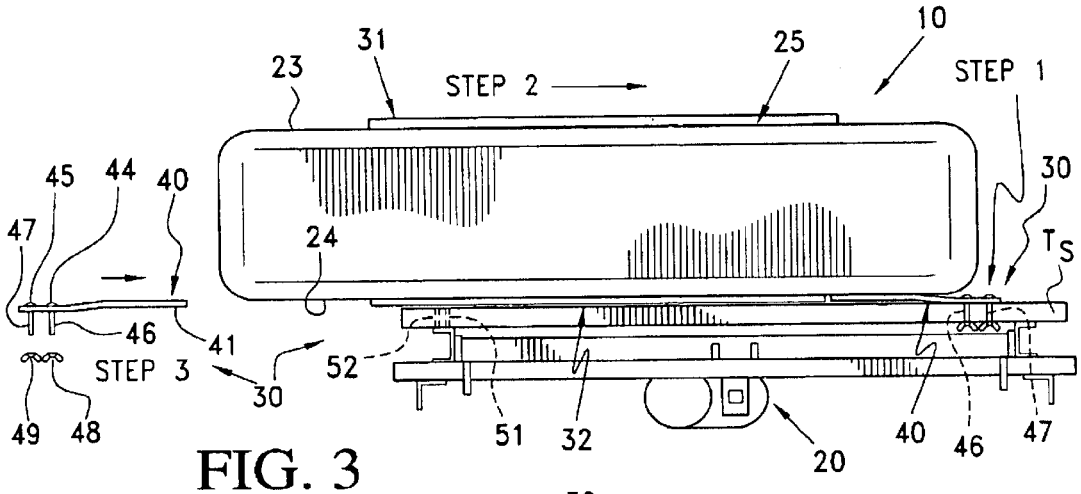
FIG. 3 is a diagrammatic end view of the adjustable bed, and illustrates the manner in which the mattress is secured to and retained upon one of the mattress supports through the cantilevered mattress retaining clips and the tubes, sleeves or pockets of the mattress cover.

The adjustable bed 10 includes a frame or foundation 15 of a relative rigid construction which may include casters or legs 16 and a peripheral wall 17 which preferably includes a quilted covering Qc and defines an interior chamber or housing 18 (FIG. 2) in which is conventionally supported a bed adjusting mechanism 20 (FIG. 3). The bed adjusting mechanism 20 forms no part of the present invention but may include all of the frames, cross-bars, linkages, pivots, pivoting mechanisms and drive motors disclosed in U.S. Pat. No. 6,276,011 B1 granted to Santino Antinori on Aug. 21, 2001, all of which are incorporated herein by reference. The bed adjusting mechanism 20 further includes four relatively movable mattress supports, namely, a leg support Ls, a thigh support Ts, a hip support Hs and a back support Bs, which are movable between a horizontal uniplanar position (FIGS. 1 and 3) and any one of a number of relatively adjusted positions (FIG. 2).

A mattress 25 (FIGS. 1, 3 and 4) is supported upon the mattress supports Ls, Ts, Hs and Bs and includes a one-piece foam latex core 21 (FIG. 4) and a fabric cover or covering 22 defined in part by an upper fabric covering portion 23 and a lower fabric covering portion 24.

A hold-down system constructed in accordance with this invention for holding the mattress 25 upon the mattress supports Ls, Ts, Hs, and Bs is generally designated by the referenced 30 and includes identical means 31, 32 for defining respectively upper and lower pocket means, pockets, sleeves or tubes defining axially opposite openings (unnumbered) in each of which is received a cantilevered end 41 of clip means or bracket means 40 (FIG. 5) for retaining the mattress 25 relatively immobile relative to the mattress supports Ls, Ts, Hs and Bs irrespective of the position of the mattress supports when moving or in any stationary position of adjustment thereof. Each of the clip means or cantilevered mattress retention clips 40 further includes an end 42 remote from the end 41 and offset relatively thereto by an offset medial portion 43. The end portion 42 of each of the cantilevered mattress retention clips 40 includes a pair of aligned elongated slots 44, 45 through which pass respective bolts 46, 47 (FIG. 4) which pass through respective openings 51, 52 of the thigh support Ts and are held thereto by thumb screws 48, 49, respectively. As is most readily apparent from FIG. 1, with the end portions 41, 41 of the cantilevered mattress retention clips 40, 40 being received in the opposite ends of the lower tube or pocket 32 (FIG. 4), the mattress 25 is rendered substantially immobile and cannot slip from or off the mattress supports Ls, Ts, Hs and/or Bs, no matter the positions of the latter. The hold-down system 30 thereby eliminates the use of conventional foot and/or side mattress retainers and absent the latter, the adjustable bed 10 has the appearance of a conventional "normal" bed (FIG. 1) which renders the same much more marketable because the adjustable bed 10 appears to be a mainstream conventional bed and thus is more marketable to a larger customer base.

Each of the pockets or tubes 31, 32 is preferably made of relatively strong fabric material which is adhesively bonded or sewn to the respective upper and lower fabric covering portions 23, 24 of the mattress cover 22. The fabric material of the pockets 31, 32 is very thin, lies substantially flat (pocket 31 of FIGS. 1 and 3) and cannot be readily visually seen or discerned when the mattress 25 is covered by a mattress overlay, a sheet, blanket and/or the like, and more importantly a person lying atop the mattress 25, no matter which covering portion 23, 24 is uppermost, cannot "feel" the respective tube or pocket 31, 32, respectively. Thus, the mattress can be occasionally "flipped" or turned, as is conventional, and no matter which covering portion 23, 24 of the fabric cover 22 is uppermost or lowermost, the uppermost pocket, tube or sleeve 31 or 32 will not be readily seen or felt by a person while the then lower tube or pocket 31 or 32 can be connected to the mattress retention clips 40, 40.

The mattress 25 is also readily assembled to the adjustable bed 10 and specifically to the mattress supports Ls, Ts, Hs and/or Bs thereof by first drilling two pairs of the holes 51, 52 in transverse alignment with each other at opposite longitudinal edges (unnumbered) of the thigh support Ts at a distance prescribed by the manufacture of the adjustable bed 10 depending upon a number of factors, such as the bed size (single, double, queen, king, etc.), the overall end-to-end length of the tubes, sleeves or pockets 31, 32, etc. However, the transversely spaced pairs of openings 51, 52; 51, 52 are spaced a distance such that ends 41, 41 of the opposing cantilevered mattress retention clips 40, 40 are fully housed in the pockets or tubes 31 or 32 (FIG. 4) whereby lateral or transverse and longitudinal shifting or movement of the mattress 25 is virtually eliminated. After establishing such distances, the pairs of holes 51, 52; 51, 52 are drilled through the thigh support Ts.

Figure 4:
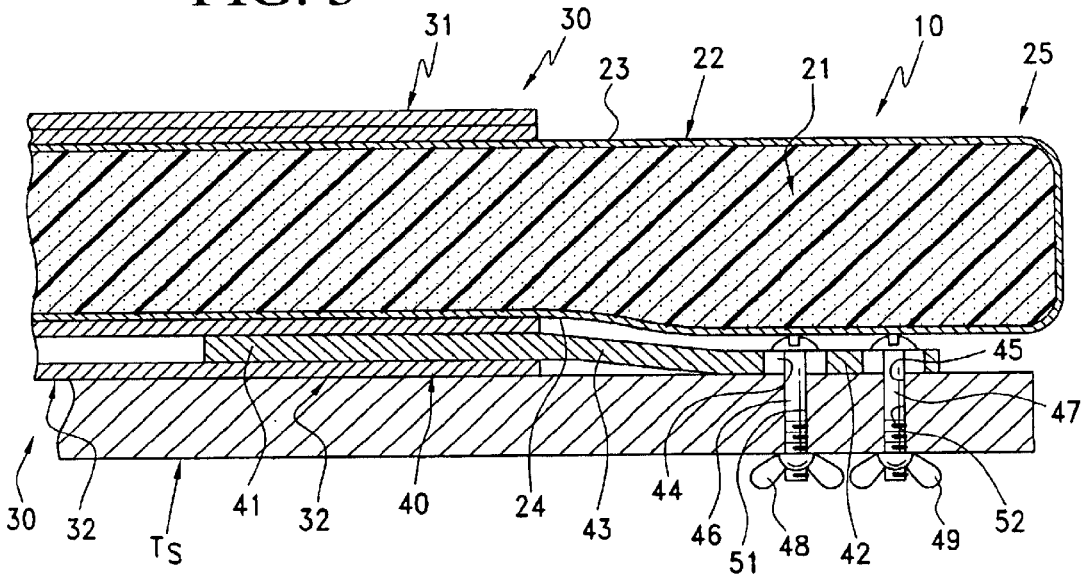
FIG. 4 is an enlarged fragmentary transverse cross sectional view taken generally along line 4—4 of FIG. 1, and illustrates one of the cantiievered mattress retaining clips received in an end of the underside or lower tube, sleeve or pocket with the upper side or upper tube, sleeve or pocket being substantially flattened.
Figure 5:
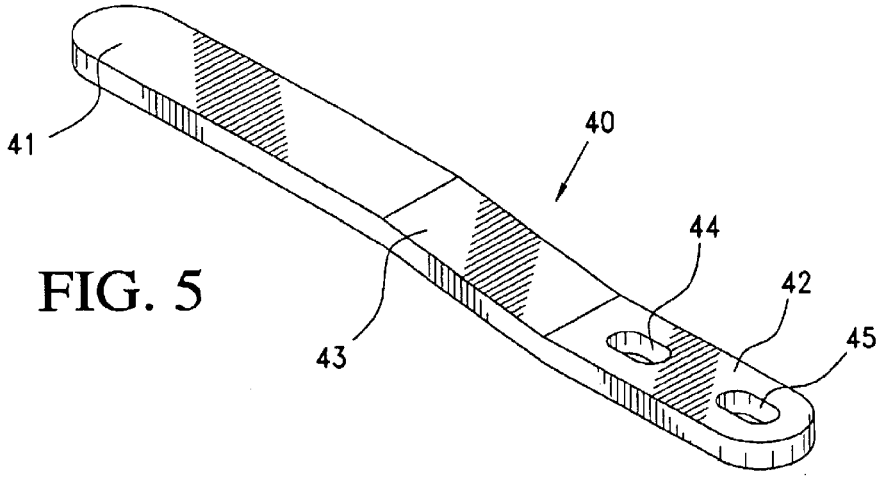
FIG. 5 is a perspective view of one of the mattress retaining clips or brackets of the invention, and illustrates opposite end portions disposed in substantially parallel planes and an offset medial portion therebetween.

Reference is made to FIG. 3 which illustrates as STEP 1 the securement of the right-hand mattress retention clip 40 to the thigh support Ts by passing the bolts 46, 47 through the respective slots 44, 45 of the mattress retention clip 40 and through the respective openings 51, 52 (FIG. 4) of the thigh support Ts. The wing nuts 48, 49 are then threaded to the respective bolts 46, 47 (FIG. 4). Thereafter, STEP 2 is performed, namely, the mattress 25 is bodily slid from left-to-right, as viewed in FIG. 3, with the pocket or tube 32 being aligned with the end portion 41 of the right-hand cantilevered retention clip 40 allowing the ready insertion of the end portion 41 of the retention clip 40 progressively into the pocket 32 until the position shown in FIG. 4 is reached. Thereafter, bolts 46, 47 are inserted into the respective openings 44, 45 of the left-hand mattress retention bracket 40, as indicated in STEP 3, and the left-hand mattress retention bracket 40 is aligned with and moved toward the left-hand end of the pocket 32 until the end portion 41 thereof has been fully inserted into the pocket 32. During the latter insertion, the left end of the mattress 25, as viewed in FIG. 3, can be lifted slightly (5–15 degrees) which is sufficient to view the left side openings or holes 51, 52 and align the bolts 46, 47, respectively, therewith. Thereafter the left-hand end of the mattress 25 can be progressively lowered to progressively introduce the bolts 46, 47 into and through the left-hand pair of openings 51, 52 in the thigh support Ts. The wing nuts 48, 49 are then hand-tightened upon the left-hand pair of bolts 46, 47 resulting in the structural relationship of the retention system 30 illustrated in FIG. 1 and the attendant functions of maintaining longitudinal and transverse stability of the mattress 25 with respect to the mattress supports Ls, Ts, Hs and Bs.

Figure 6:
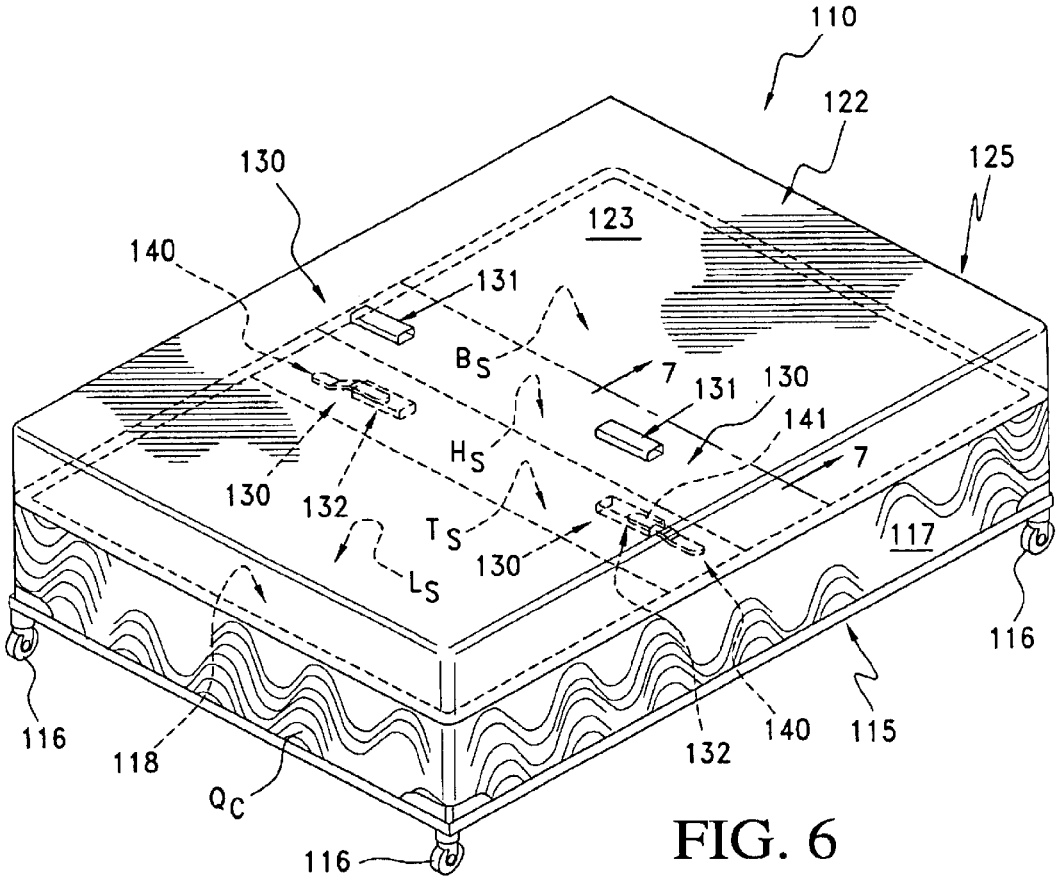
FIG. 6 is a perspective view of another adjustable bed, and illustrates a mattress having pairs of transversely aligned pockets secured to a mattress cover at upper and lower surfaces of the mattress with cantilevered mattress retention clips being received in a lower pair of the pockets.
Figure 7:
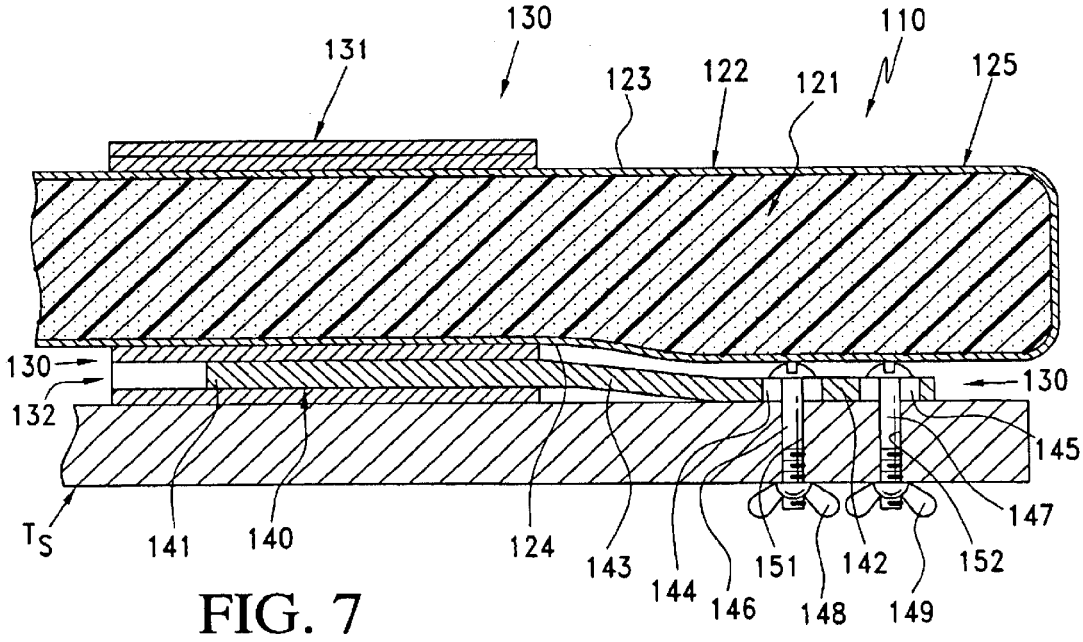
FIG. 7 is an enlarged fragmentary cross sectional view taken generally along line 7—7 of FIG. 6, and illustrates an end of one of the cantilevered mattress retention clips housed within one of the mattress cover lower side pockets.

Another adjustable bed constructed in accordance with this invention is illustrated in FIGS. 6 and 7 of the drawings and is generally designated by the reference numeral 110.

The adjustable bed 110 includes a frame or foundation 115 of a relative rigid construction which may include casters or legs 116 and a peripheral wall 117 which preferably includes a quilted covering Qc and defines an interior chamber or housing 118 (FIG. 6) in which is conventionally supported a bed adjusting mechanism corresponding to the bed adjusting mechanism 20 of FIG. 3. The bed adjusting mechanism includes four relatively movable mattress supports, namely, a leg support Ls, a thigh support Ts, a hip support Hs and a back support Bs, which are movable between a horizontal uniplanar position (FIGS. 6 and 7) and any one of a number of relatively adjusted positions (FIG. 2).

A mattress 125 (FIGS. 6 and 7) is supported upon the mattress supports Ls, Ts, Hs and Bs and includes a one-piece foam latex core 121 (FIG. 6) and a fabric cover or covering 122 defined in part by an upper fabric covering portion 123 and a lower fabric covering portion 124.

A hold-down system constructed in accordance with this invention for holding the mattress 125 upon the mattress supports Ls, Ts, Hs, and Bs is generally designated by the referenced 130 and includes identical pairs of means 131, 131; 132, 132 for defining respectively upper and lower pocket means, pockets, sleeves or tubes each defining axially opposite openings (unnumbered) in one of which is received a cantilevered end 141 of clip means or bracket means 140 (FIG. 7) for retaining the mattress 125 relatively immobile relative to the mattress supports Ls, Ts, Hs and Bs irrespective of the position of the mattress supports when moving or in any stationary position of adjustment thereof. Each of the clip means or cantilevered mattress retention clips 140 further includes an end 142 remote from the end 141 and offset relatively thereto by an offset medial portion 143. The end portion 142 of each of the cantilevered mattress retention clips 140 includes a pair of aligned elongated slots 144, 145 through which pass respective bolts 146, 147 (FIG. 7) which pass through respective openings 151, 152 of the thigh support Ts and are held thereto by thumb screws 148, 149, respectively. As is most readily apparent from FIG. 6, with the end portions 141, 141 of the cantilevered mattress retention clips 140, 140 being received in the opposite ends of the lower pair of tubes or pockets 132 (FIG. 7), the mattress 125 is rendered substantially immobile and cannot slip from or off the mattress supports Ls, Ts, Hs and/or Bs, no matter the positions of the latter. The hold-down system 130 thereby eliminates the use of conventional foot and/or side mattress retainers and absent the latter, the adjustable bed 110 has the appearance of a conventional "normal" bed (FIG. 6) which renders the same much more marketable because the adjustable bed 110 appears to be a mainstream conventional bed and thus is more marketable to a larger customer base.

Each of the pockets or tubes 131, 132 is preferably made of relatively strong fabric material which is adhesively bonded or sewn to the respective upper and lower fabric covering portions 123, 124 of the mattress cover 122. The fabric material of the pockets 131, 132 is very thin, lies substantially flat (pockets 131 of FIGS. 6 and 7) and cannot be readily visually seen or discerned when the mattress 125 is covered by a mattress overlay, a sheet, blanket and/or the like, and more importantly a person lying atop the mattress 125, no matter which covering portion 123, 124 is uppermost, cannot "feel" the respective pairs of tubes or pockets 131, 132, respectively. Thus, the mattress can be occasionally "flipped" or turned, as is conventional, and no matter which covering portion 123, 124 of the fabric cover 122 is uppermost or lowermost, the uppermost pair of pockets, tubes or sleeves 131 or 132 will not be readily seen or felt by a person while the then lower pair of tubes or pockets 131 or 132 can be connected to the mattress retention clips 140, 140.

The mattress 125 is also readily assembled to the adjustable bed 110 and specifically to the mattress supports Ls, Ts, Hs and/or Bs thereof in the manner heretofore described with respect to FIGS. 1 through 5 of the drawings. The later descriptions (and corresponding reference numerals) are hereat incorporated by reference.

Figure 8:
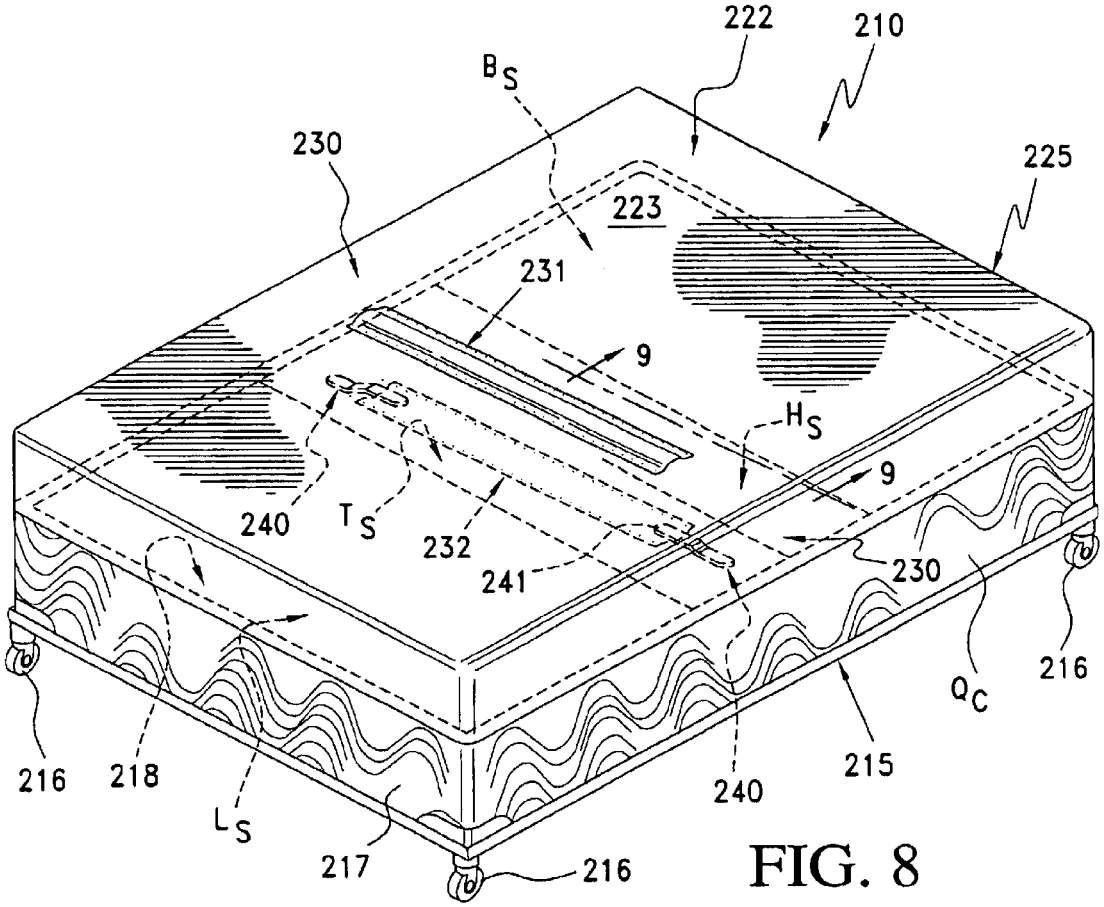
FIG. 8 is a perspective view of another adjustable bed, and illustrates transversely disposed pockets or tubes each formed by a single strip of fabric material carried by upper and lower portions of the mattress cover with the lower tube receiving opposing ends of cantilevered mattress retention clips in open ends thereof.
Figure 9:
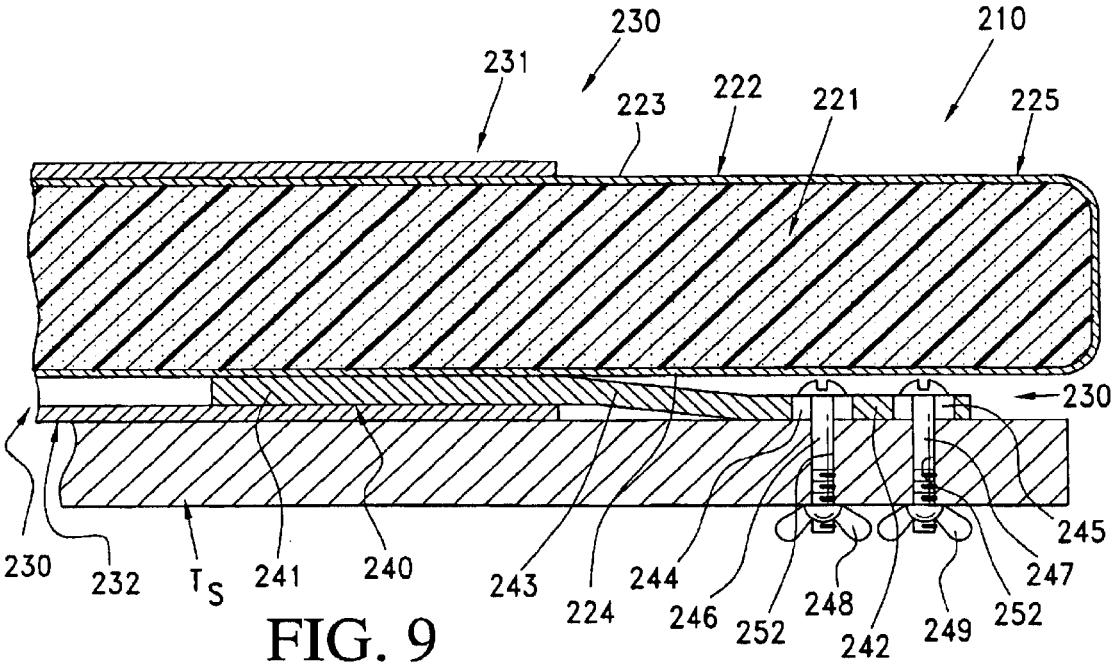
FIG. 9 is a fragmentary enlarged cross sectional view taken generally along line 9—9 of FIG. 8, and illustrates details of an end of the cantilevered mattress retention clip being received in the pocket or tube.

Another adjustable bed constructed in accordance with this invention is illustrated in FIGS. 8 and 9 of the drawings and is generally designated by the reference numeral 210.

The adjustable bed 210 includes a frame or foundation 215 of a relative rigid construction which may include casters or legs 216 and a peripheral wall 217 which preferably includes a quilted covering Qc and defines an interior chamber or housing 218 (FIG. 8) in which is conventionally supported a bed adjusting mechanism corresponding to the bed adjusting mechanism 20 of FIG. 3. The bed adjusting mechanism further includes four relatively movable mattress supports, namely, a leg support Ls, a thigh support Ts, a hip support Hs and a back support Bs, which are movable between a horizontal uniplanar position (FIGS. 9 and 9) and any one of a number of relatively adjusted positions (such as FIG. 2).

A mattress 225 (FIGS. 8 and 9) is supported upon the mattress supports Ls, Ts, Hs and Bs and includes a one-piece foam latex core 221 (FIG. 9) and a fabric cover or covering 222 defined in part by an upper fabric covering portion 223 and a lower fabric covering portion 224.

A hold-down system constructed in accordance with this invention for holding the mattress 225 upon the mattress supports Ls, Ts, Hs, and Bs is generally designated by the referenced 230 and includes identical means 231, 232 for defining respectively upper and lower pocket means, pockets, sleeves or tubes defining axially opposite openings (unnumbered) in each of which is received a cantilevered end 241 of clip means or bracket means 240 (FIG. 9) for retaining the mattress 225 relatively immobile relative to the mattress supports Ls, Ts, Hs and Bs irrespective of the position of the mattress supports when moving or in any stationary position of adjustment thereof. Each of the clip means or cantilevered mattress retention clips 240 further includes an end 242 remote from the end 241 and offset relatively thereto by an offset medial portion 243. The end portion 242 of each of the cantilevered mattress retention clips 240 includes a pair of aligned elongated slots 244, 245 through which pass respective bolts 246, 247 (FIG. 9) which pass through respective openings 251, 252 of the thigh support Ts and are held thereto by thumb screws 248, 249, respectively. As is most readily apparent from FIG. 8, with the end portions 241, 241 of the cantilevered mattress retention clips 240, 240 being received in the opposite ends of the lower tube or pocket 232 (FIG. 9), the mattress 225 is rendered substantially immobile and cannot slip from or off the mattress supports Ls, Ts, Hs and/or Bs, no matter the positions of the latter. The hold-down system 230 thereby eliminates the use of conventional foot retainer brackets and absent the latter, the adjustable bed 10 has the appearance of a conventional "normal" bed (FIG. 8) which renders the same much more marketable because the adjustable bed 210 appears to be a mainstream conventional bed and thus is more marketable to a larger customer base.

Each of the pockets or tubes 231, 232 is preferably made of relatively strong fabric material which is adhesively bonded or sewn along opposite longitudinal edges thereof to the respective upper and lower fabric covering portions 223, 224 of the mattress cover 222. The fabric material of the pockets 231, 232 is very thin, lies substantially flat (pocket 231 of FIGS. 8 and 9) and cannot be readily visually seen or discerned when the mattress 225 is covered by a mattress overlay, a sheet, blanket and/or the like, and more importantly a person lying atop the mattress 225, no matter which covering portion 223, 224 is uppermost, cannot "feel" the respective uppermost tube or pocket 231, 232, respectively. Thus, the mattress can be occasionally "flipped" or turned, as is conventional, and no matter which covering portion 223, 224 of the fabric cover 222 is uppermost or lowermost, the uppermost pocket, tube or sleeve 231 or 232 will not be readily seen or felt by a person while the then lower tube or pocket 231 or 232 can be connected to the mattress retention clips 240, 240.

The mattress 225 is also readily assembled to the adjustable bed 210 and specifically to the mattress supports Ls, Ts, Hs and/or Bs thereof in the manner heretofore described with respect to FIGS. 1 through 5 of the drawings. The latter description (and corresponding reference numerals) are hereat incorporated by reference.

Figure 10:
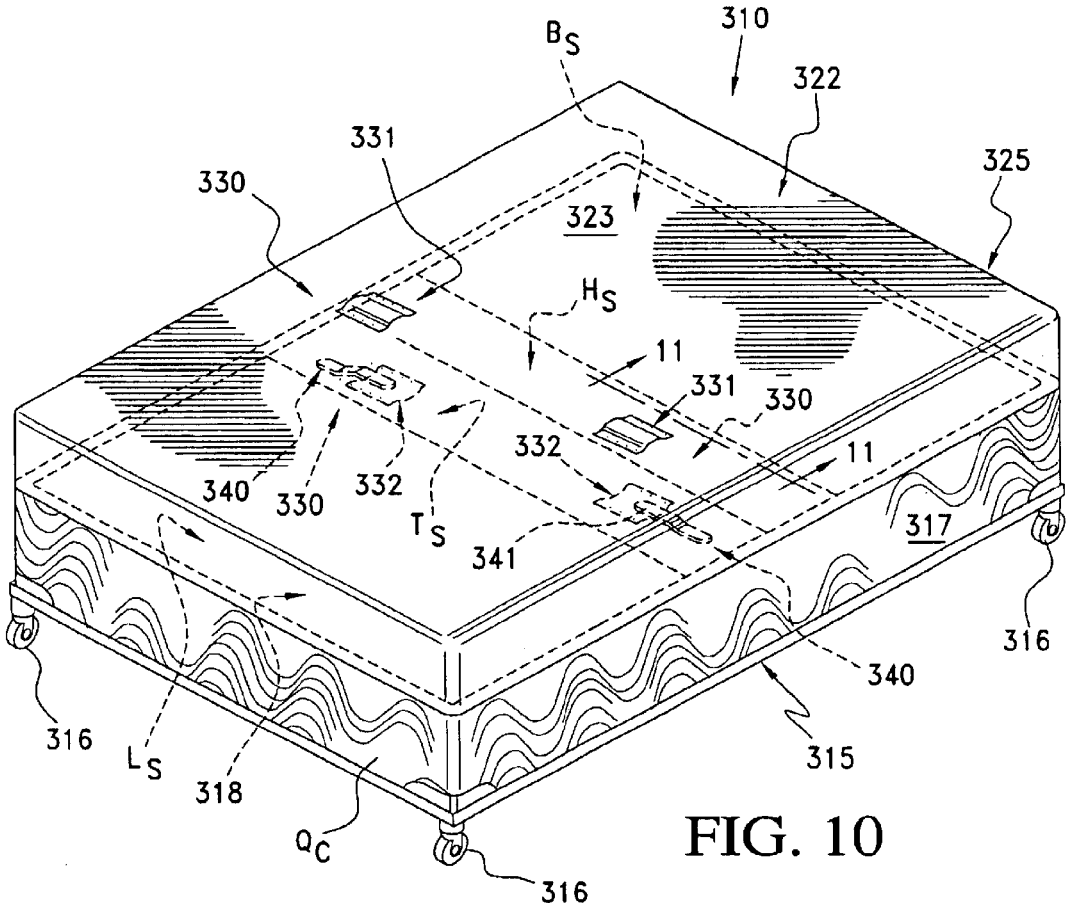
FIG. 10 is a perspective view of another adjustable bed, and illustrates pairs of transversely aligned pockets at upper and lower surfaces of a mattress cover or covering of the mattress and ends of cantilevered mattress retention clips being received in the lower pockets.
Figure 11:
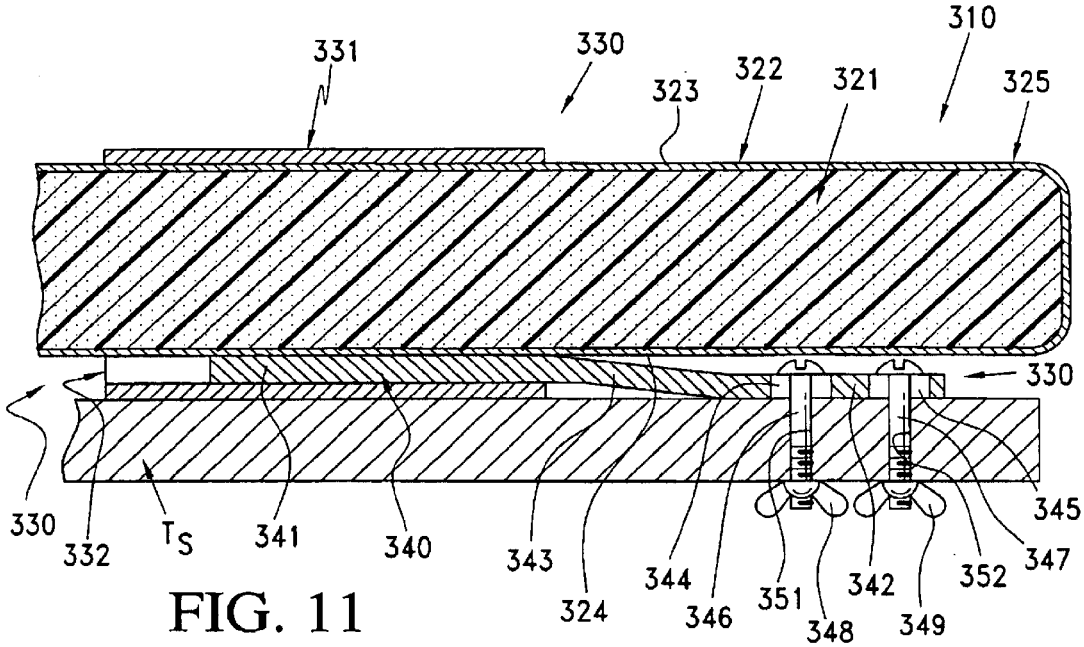
FIG. 11 is a fragmentary enlarged cross sectional view taken generally along line 11—11 of FIG. 10, and illustrated details of an end portion of one of the cantilevered mattress retention brackets being received in one of the pockets.

Another adjustable bed constructed in accordance with this invention is illustrated in FIGS. 10 and 11 of the drawings and is generally designated by the reference numeral 310.

The adjustable bed 310 includes a frame or foundation 315 of a relative rigid construction which may include casters or legs 316 and a peripheral wall 317 which preferably includes a quilted covering Qc and defines an interior chamber or housing 318 (FIG. 10) in which is conventionally supported a bed adjusting mechanism corresponding to the bed adjusting mechanism 20 of FIG. 3. The bed adjusting mechanism further includes four relatively movable mattress supports, namely, a leg support Ls, a thigh support Ts, a hip support Hs and a back support Bs, which are movable between a horizontal uniplanar position (FIGS. 10 and 11) and any one of a number of relatively adjusted positions (such as FIG. 2).

A mattress 325 (FIGS. 10 and 11) is supported upon the mattress supports Ls, Ts,. Hs and Bs and includes a one-piece foam latex core 321 (FIG. 11) and a fabric cover or covering 322 defined in part by an upper fabric covering portion 323 and a lower fabric covering portion 324.

A hold-down system constructed in accordance with this invention for holding the mattress 325 upon the mattress supports Ls, Ts, Hs, and Bs is generally designated by the referenced 330 and includes identical pairs of means 331, 331; 332, 332 for defining respectively upper and lower pairs of pocket means, pockets, sleeves or tubes each defining axially opposite openings (unnumbered) in one of which is received a cantilevered end 341 of clip means or bracket means 340 (FIG. 11) for retaining the mattress 325 relatively immobile relative to the mattress supports Ls, Ts, Hs and Bs irrespective of the position of the mattress supports when moving or in any stationary position of adjustment thereof. Each of the clip means or cantilevered mattress retention clips 340 further includes an end 342 remote from the end 341 and offset relatively thereto by an offset medial portion 343. The end portion 342 of each of the cantilevered mattress retention clips 340 includes a pair of aligned elongated slots 344, 345 through which pass respective bolts 346, 347 (FIG. 11) which pass through respective openings 351, 352 of the thigh support Ts and are held thereto by thumb screws 348, 349, respectively. As is most readily apparent from FIG. 11, with the end portions 341, 341 of the cantilevered mattress retention clips 340, 340 being received in the opposite ends of the lower tube or pocket 332 (FIG. 10), the mattress 325 is rendered substantially immobile and cannot slip from or off the mattress supports Ls, Ts, Hs and/or Bs, no matter the positions of the latter. The hold-down system 330 thereby eliminates the use of conventional foot retainer brackets and absent the latter, the adjustable bed 310 has the appearance of a conventional "normal" bed (FIG. 10) which renders the same much more marketable because the adjustable bed 310 appears to be a mainstream conventional bed and thus is more marketable to a larger customer base.

Each of the pockets or tubes 331, 332 is preferably made of relatively strong fabric material which is adhesively bonded or sewn along opposite longitudinal edges thereof to the respective upper and lower fabric covering portions 323, 324 of the mattress cover 322. The fabric material of the pockets 331, 332 is very thin, lies substantially flat (pocket 331 of FIG. 11) and cannot be readily visually seen or discerned when the mattress 325 is covered by a mattress overlay, a sheet, blanket and/or the like, and more importantly a person lying atop the mattress 325, no matter which covering portion 323, 324 is uppermost, cannot "feel" the respective uppermost tube or pocket 331, 332, respectively. Thus, the mattress can be occasionally "flipped" or turned, as is conventional, and no matter which covering portion 323, 324 of the fabric cover 322 is uppermost or lowermost, the uppermost pocket, tube or sleeve 331 or 332 will not be readily seen or felt by a person while the then lower tube or pocket 331 or 332 can be connected to the mattress retention clips 340, 340.

The mattress 325 is also readily assembled to the adjustable bed 310 and specifically to the mattress supports Ls, Ts, Hs and/or Bs thereof in the manner heretofore described with respect to FIGS. 1 through 5 of the drawings. The latter descriptions (and corresponding reference numerals) are hereat incorporated by reference.

Another adjustable bed constructed in accordance with this invention is illustrated in FIGS. 12 and 13 of the drawings and is generally designated by the reference numeral 410.

The adjustable bed 410 includes a frame or foundation 415 of a relative rigid construction which may include casters or legs 416 and a peripheral wall 417 which preferably includes a quilted covering Qc and defines an interior chamber or housing 418 (FIG. 12) in which is conventionally supported a bed adjusting mechanism corresponding to the bed adjusting mechanism 20 of FIG. 3. The bed adjusting mechanism further includes four relatively movable mattress supports, namely, a leg support Ls, a thigh support Ts, a hip support Hs and a back support Bs, which are movable between a horizontal uniplanar position (FIGS. 12 and 13) and any one of a number of relatively adjusted positions (such as FIG. 2).

A mattress 425 (FIGS. 12 and 13) is supported upon the mattress supports Ls, Ts, Hs and Bs and includes a one-piece foam latex core 421 (FIG. 13) and a fabric cover or covering 422 defined in part by an upper fabric covering portion 423 and a lower fabric covering portion 424.

A hold-down system constructed in accordance with this invention for holding the mattress 425 upon the mattress supports Ls, Ts, Hs, and Bs is generally designated by the referenced 430 and includes identical means 431, 432 for defining respectively upper and lower interior or inner pocket means, pockets, sleeves or tubes defining axially opposite openings (unnumbered) in each of which is received a cantilevered end 441 of clip means or bracket means 440 (FIG. 13) for retaining the mattress 425 relatively immobile relative to the mattress supports Ls, Ts, Hs and Bs irrespective of the position of the mattress supports when moving or in any stationary position of adjustment thereof. Each of the clip means or cantilevered mattress retention clips 440 further includes an end 442 remote from the end 441 and offset relatively thereto by an offset medial portion 443. The end portion 442 of each of the cantilevered mattress retention clips 440 includes a pair of aligned elongated slots 444, 445 through which pass respective bolts 446, 447 (FIG. 13) which pass through respective openings 451, 452 of the thigh support Ts and are held thereto by thumb screws 448, 449, respectively. As is most readily apparent from FIG. 12, with the end portions 441, 441 of the cantilevered mattress retention clips 440, 440 being received in the opposite ends of the lower tube or pocket 432 (FIG. 13), the mattress 425 is rendered substantially immobile and cannot slip from or off the mattress supports Ls, Ts, Hs and/or Bs, no matter the positions of the latter. The hold-down system 430 thereby eliminates the use of conventional foot retainer brackets and absent the latter, the adjustable bed 410 has the appearance of a conventional "normal" bed (FIG. 12) which renders the same much more marketable because the adjustable bed 410 appears to be a mainstream conventional bed and thus is more marketable to a larger customer base.

Each of the pockets or tubes 431, 432 is preferably made of relatively strong fabric material which is adhesively bonded or sewn to inner surfaces (unnumbered) of the respective upper and lower fabric covering portions 423, 424 of the mattress cover 422. Slits or openings S1, S1 are formed through the uppermost and lowermost fabric portions 423, 424 of the mattress cover 422 immediately adjacent the openings (unnumbered) of the pockets 431, 432. The end portions 441, 441 of the mattress retention clips 440, 440 pass through the slits S1, S1 (FIG. 13) during the introduction thereof into the interior pockets 431, 432. The fabric material of the inner pockets 431, 432 is very thin, lies substantially flat (pocket 431 of FIGS. 12 and 13) and cannot be readily discerned, particularly when the mattress 425 is covered by a mattress overlay, a sheet, blanket and/or the like, and more importantly a person lying atop the mattress 425, no matter which covering portion 423, 424 is uppermost, cannot "feel" the respective uppermost inner tube or pocket 431, 432, respectively. Thus, the mattress can be occasionally "flipped" or turned, as is conventional, and no matter which covering portion 423, 424 of the fabric cover 422 is uppermost or lowermost, the uppermost inner pocket, tube or sleeve 431 or 432 will not be readily seen or felt by a person while the then lower tube or pocket 431 or 432 can be connected to the mattress retention clips 440, 440.

The mattress 425 is also readily assembled to the adjustable bed 410 and specifically to the mattress supports Ls, Ts, Hs and/or Bs thereof in the manner heretofore described with respect to FIGS. 1 through 5 of the drawings. The latter descriptions (and corresponding reference numerals) are hereat incorporated by reference.

Another adjustable bed constructed in accordance with this invention is illustrated in FIGS. 14 and 15 of the drawings and is generally designated by the reference numeral 510.

The adjustable bed 510 includes a frame or foundation 515 of a relative rigid construction which may include casters or legs 516 and a peripheral wall 517 which preferably includes a quilted covering Qc and defines an interior chamber or housing 518 (FIG. 14) in which is conventionally supported a bed adjusting mechanism corresponding to the bed adjusting mechanism 20 of FIG. 3. The bed adjusting mechanism further includes four relatively movable mattress supports, namely, a leg support Ls, a thigh support Ts, a hip support Hs and a back support Bs, which are movable between a horizontal uniplanar position (FIGS. 14 and 15) and any one of a number of relatively adjusted positions (such as FIG. 2).

A mattress 525 (FIGS. 14 and 15) is supported upon the mattress supports Ls, Ts, Hs and Bs and includes a one-piece foam latex core 521 (FIG. 15) and a fabric cover or covering 522 defined in part by an upper fabric covering portion 523 and a lower fabric covering portion 524.

A hold-down system constructed in accordance with this invention for holding the mattress 525 upon the mattress supports Ls, Ts, Hs, and Bs is generally designated by the referenced 530 and includes identical pairs of means 531, 532 for defining respectively upper and lower pairs of inner or interior pocket means, pockets, sleeves or tubes each defining transversely remote axially opposite openings (unnumbered) in one each of which is received a cantilevered end 541 of clip means or bracket means 540 (FIG. 15) for retaining the mattress 525 relatively immobile relative to the mattress supports Ls, Ts, Hs and Bs irrespective of the position of the mattress supports when moving or in any stationary position of adjustment thereof. Each of the clip means or cantilevered mattress retention clips 540 further includes an end 542 remote from the end 541 and offset relatively thereto by an offset medial portion 543. The end portion 542 of each of the cantilevered mattress retention clips 540 includes a pair of aligned elongated slots 544, 545 through which pass respective bolts 546, 547 (FIG. 15) which pass through respective openings 551, 552 of the thigh support Ts and are held thereto by thumb screws 548, 549, respectively. As is most readily apparent from FIG. 15, with the end portions 541, 541 of the cantilevered mattress retention clips 540, 540 being received in the opposite ends of the lower tube or pocket 532 (FIG. 15), the mattress 525 is rendered substantially immobile and cannot slip from or off the mattress supports Ls, Ts, Hs and/or Bs, no matter the positions of the latter. The hold-down system 530 thereby eliminates the use of conventional foot retainer brackets and absent the latter, the adjustable bed 510 has the appearance of a conventional "normal" bed (FIG. 14) which renders the same much more marketable because the adjustable bed 510 appears to be a mainstream conventional bed and thus is more marketable to a larger customer base.

Each of the pockets or tubes 531, 532 is preferably made of relatively strong fabric material which is adhesively bonded or sewn to the respective upper and lower fabric covering portions 523, 524 of the mattress cover 522. Slits or openings S1, S1 are formed through the uppermost and lowermost fabric portions 523, 524 of the mattress cover 522 immediately adjacent the openings (unnumbered) of the pockets 531, 532. The end portions 541, 541 of the mattress retention clips 540, 540 pass through the slits S1, S1 (FIG. 15) during the introduction thereof into the interior pockets 531, 532. The fabric material of the pockets 531, 532 is very thin, lies substantially flat (pocket 531 of FIG. 15) and cannot be readily visually seen or discerned when the mattress 525 is covered by a mattress overlay, a sheet, blanket and/or the like, and more importantly a person lying atop the mattress 525, no matter which covering portion 523, 524 is uppermost, cannot "feel" the respective uppermost tube or pocket 531, 532, respectively. Thus, the mattress can be occasionally "flipped" or turned, as is conventional, and no matter which covering portion 523, 524 of the fabric cover 522 is uppermost or lowermost, the uppermost pocket, tube or sleeve 531 or 532 will not be readily seen or felt by a person while the then lower tube or pocket 531 or 532 can be connected to the mattress retention clips 540, 540.

The mattress 525 is also readily assembled to the adjustable bed 510 and specifically to the mattress supports Ls, Ts, Hs and/or Bs thereof in the manner heretofore described with respect to FIGS. 1 through 5 of the drawings. The latter descriptions (and corresponding reference numerals) are hereat incorporated by reference.

Various structural alternatives will be apparent to a person skilled in the art after having reviewed the latter descriptions of the various embodiments of the present invention. For example, though the mattress retaining clips 40, 40; 140, 140; etc., have been described as being secured in pairs to the thigh support Ts, the same can be as well secured to any one of the other mattress supports Ls, Hs and/or Bs. Furthermore, instead of utilizing two opposing pairs of mattress retention clips 40, 40; 140, 140, two or more pairs of the mattress retention clips 40, 40; 140, 140, etc., can be utilized with each pair being preferably secured to one of the supports Ls, Ts, Hs and Bs. For example, in the embodiment of the invention illustrated in FIG. 2, a second pair of the mattress retention clips 40, 40 can be secured to the back support Bs or to the leg support Ls or to both.

The strip of material 231, 232 of FIGS. 8 and 9 of the mattress 225 which are sewn or otherwise secured to the exterior of the mattress cover 222 can as well be sewn to the interior surfaces thereof which would merely require a slit S1 to be formed in the cover portions 223, 224 adjacent the ends (unnumbered) of the interior "tubes" or "pockets 231, 232. The latter structure would correspond substantially identically to that heretofore described with respect to the respective sleeves, tubes or pockets 431, 432 of FIGS. 12 and 13.

The pairs of tubes or pockets 131, 132; 333, 332 can also be closed at innermost ends by transverse stitching such that each of the latter pockets has a closed or "blind" end. The transverse stitching achieves additional reinforcement. Like reinforced stitching may also be applied in the area of the slits S1, S2 for reinforcement purposes.

Although a preferred embodiment of the invention has been specifically illustrated and described herein, it is to be understood that minor variations may be made in the apparatus without departing from the spirit and scope of the invention, as defined by the appended claims.

What is claimed is:

1. A hold-down system comprising an elongated support having a longitudinal axis and a transverse axis and an elongated element having a longitudinal axis and a transverse axis, said element resting upon said support with the longitudinal axes and the traverse axes being disposed in substantially parallel relationship to each other, means for defining a flexible material pocket with respect to one of said elongated support and said elongated element, said flexible material pocket including an opening having an axis disposed tranversely to one of both said longitudinal axes and one of both of said transverse axes, and means carried by the other of said elongated support and said elongated element for sliding reception into said flexible pocket opening along the axis thereof whereby said elongated element is held down upon said elongated support.

2. The hold-down system as defined in claim 1 wherein said pocket opening axis and said reception means are each disposed in substantial transverse relationship to said longitudinal axes.

3. The hold-down system as defined in claim 1 wherein said flexible material pocket is a substantially tubular configuration.

4. The hold-down system as defined in claim 1 wherein said reception means is an elongated member.

5. The hold-down system as defined in claim 1 wherein said reception means is carried in substantially cantilevered relationship relative to the other of said support and said element.

6. The hold-down system as defined in claim 1 wherein said support is part of a bed and said element is a mattress.

7. The hold-down system as defined in claim 1 including further means carried by the other of said support and said element for reception in said pocket means whereby said element is held down upon said support.

8. The hold-down system as defined in claim 1 including further means carried by the other of said support and said element for reception in said flexible material pocket in opposing relationship to said first-mentioned reception means whereby said element is held down upon said support.

9. The hold-down system as defined in claim 1 including further means carried by the other of said support and said element for reception in said flexible material pocket in axial opposing relationship to said first-mentioned reception means whereby said element is held down upon said support.

10. The hold-down system as defined in claim 1 wherein said flexible material pocket is a substantially tubular pocket.

11. The hold-down system as defined in claim 1 wherein said flexible material pocket is a substantially tubular fabric pocket.

12. The hold-down system as defined in claim 1 including fastener means for fastening said reception means to the other of said support and said element.

13. The hold-down system as defined in claim 1 wherein said support is a mattress support and said element is a mattress, said flexible material pocket is part of said mattress, and said reception means is carried by said mattress support.

14. The hold-down system as defined in claim 13 including means for defining another flexible material pocket for the reception of said reception means, and said first-mentioned and said another flexible material pocket are on opposite sides of said mattress.

15. The hold-down system as defined in claim 13 including means for defining another flexible material pocket for the reception of said reception means, said first-mentioned and said another flexible material pocket are on opposite sides of said mattress, and at least one of said first-mentioned and another flexible material pocket is a tubular member.

16. The hold-down system as defined in claim 13 wherein said mattress includes a mattress cover, and said flexible material pocket is defined by a piece of material having opposite edges secured to said mattress cover.

17. The hold-down system as defined in claim 13 wherein said mattress includes a mattress cover, and said flexible material pocket is defined by a piece of material exterior of said mattress cover having opposite edges secured to an outer surface of said mattress cover.

18. The hold-down system as defined in claim 13 wherein said mattress includes a mattress cover, and said flexible material pocket is defined by a piece of material interior of said mattress cover having opposite edges secured to an inner surface of said mattress cover.

19. The hold-down system as defined in claim 13 wherein said mattress includes a mattress cover, said flexible material pocket is defined by a piece of material interior of said mattress cover having opposite edges secured to an inner surface of said mattress cover, and said pocket opening is in said cover for accessing said reception means therethrough into said flexible material pocket.

20. The hold-down system as defined in claim 13 wherein said mattress includes a cover, and said pocket opening is in said cover for the receipt of said reception means.

21. The hold-down system as defined in claim 13 including another means for defining another flexible material pocket for reception of another means carried by said mattress support for reception in said another flexible material pocket, and said first-mentioned and another flexible material pockets are disposed on a same side of the mattress.

22. The hold-down system as defined in claim 21 wherein said first-mentioned and said another flexible material pockets are each defined by a tubular member.

23. The hold-down system as defined in claim 21 wherein said mattress includes a mattress cover and said first-mentioned and said another flexible material pocket are each defined by a piece of material having opposite edges secured to said mattress cover.

24. The hold-down system as defined in claim 21 wherein said mattress includes a mattress cover and said first-mentioned and said another flexible material pockets are each defined by a piece of material exterior of said mattress cover having opposite edges secured to an outer surface of said mattress cover.

25. The hold-down system as defined in claim 21 wherein said mattress includes a mattress cover and said first-mentioned and said another flexible material pockets are each defined by a piece of material interior of said mattress cover having opposite edges secured to an inner surface of said mattress cover.

26. The hold-down system as defined in claim 21 wherein said mattress includes a mattress cover, said first-mentioned and said another flexible material pockets are each defined by a piece of material having opposite edges secured to said mattress cover, and said first and a second opening are in said cover for accessing said first-mentioned and said another reception means therethrough into said respective first-mentioned and another flexible material pockets.

27. A bed comprising a mattress support, a mattress resting upon said mattress support, said mattress including a covering, first means for defining a first opening relative to said mattress, second means for defining a second opening relative to said mattress, said first and second openings being on substantially transversely opposite sides of a longitudinal axis of said mattress, first means carried by said mattress support for entry into said first opening, and second means carried by said mattress support for entry into said second opening whereby said mattress is retained upon said mattress support.

28. The bed as defined in claim 27 wherein said first and second openings are each defined by an opening in said mattress cover.

29. The bed as defined in claim 27 wherein said first and second openings are defined by axial opposite openings of a tubular pocket.

30. The bed as defined in claim 27 wherein said first and second openings are defined by axial opposite openings of a tubular pocket located exteriorly of said mattress cover.

31. The bed as defined in claim 27 wherein said first and second openings are defined by axial opposite openings of a tubular pocket located interiorly of said mattress cover.

32. The bed as defined in claim 27 wherein said first and second openings are defined by axial opposite openings of a tubular pocket defined by a tubular member carried by said mattress cover.

33. The bed as defined in claim 27 wherein said first and second openings are defined by axial opposite openings of a tubular pocket defined by a strip of material secured at opposite edges thereof to said mattress cover.

34. The bed as defined in claim 27 wherein said first and second openings are defined by respective first and second tubular pockets.

35. The bed as defined in claim 27 wherein said first and second openings are substantially transversely aligned.

36. The bed as defined in claim 27 wherein said first and second entry means are respective first and second members each having a terminal end portion received in one of said first and second openings.

37. The bed as defined in claim 28 wherein said first and second entry means are respective first and second members each having a terminal end portion received in one of said first and second openings.

38. The bed as defined in claim 29 wherein said first and second entry means are respective first and second members each having a terminal end portion received in one of said first and second openings.

39. The bed as defined in claim 30 wherein said first and second entry means are respective first and second members each having a terminal end portion received in one of said first and second openings.

40. The bed as defined in claim 31 wherein said first and second entry means are respective first and second members each having a terminal end portion received in one of said first and second openings.

41. The bed as defined in claim 32 wherein said first and second entry means are respective first and second members each having a terminal end portion received in one of said first and second openings.

42. The bed as defined in claim 33 wherein said first and second entry means are respective first and second members each having a terminal end portion received in one of said first and second openings.

43. The bed as defined in claim 34 wherein said first and second entry means are respective first and second members each having a terminal end portion received in one of said first and second openings.

44. The bed as defined in claim 35 wherein said first and second entry means are respective first and second members each having a terminal end portion received in one of said first and second openings.

* * * * *